US005862589A

United States Patent [19]

Chadbourne et al.

[11] Patent Number: 5,862,589

[45] Date of Patent: Jan. 26, 1999

[54] TUBULAR WEDGE FOR AN ELECTRICAL WEDGE CONNECTOR

[75] Inventors: Richard Chadbourne, Merrimack; William J. Lasko, Lisbon; Armand T. Montminy, Manchester, all of N.H.

[73] Assignee: Framatome Connectors USA, Inc., Fairfield, Conn.

[21] Appl. No.: 689,285

[22] Filed: Aug. 6, 1996

Related U.S. Application Data

[62] Division of Ser. No. 353,187, Dec. 9, 1994, Pat. No. 5,830,019.

[51] Int. Cl.[6] ..... H01R 43/16

[52] U.S. Cl. ..... 29/882; 29/527.6; 29/881; 72/334; 72/348; 439/783

[58] Field of Search ..... 29/874, 876, 881, 29/868, 872, 527.5, 527.6, 882; 72/334, 348; 439/783, 784, 785, 825, 851; 174/90 R, 90 S

[56] References Cited

U.S. PATENT DOCUMENTS

| | | | |
|---|---|---|---|
| 9,782 | 6/1853 | Muntz, Jr. | 29/527.6 |
| 1,216,282 | 2/1917 | Carver et al. | 72/348 X |
| 2,106,724 | 2/1938 | Cope | 173/273 |
| 2,185,981 | 1/1940 | Haller . | |
| 2,223,853 | 12/1940 | Mebold . | |
| 2,814,025 | 11/1957 | Wade et al. . | |
| 2,828,147 | 3/1958 | Peiffer . | |
| 3,065,449 | 11/1962 | Matthysse et al. . | |
| 3,235,944 | 2/1966 | Broske et al. | 29/872 |
| 3,275,974 | 9/1966 | Mixon, Jr. . | |
| 3,329,928 | 7/1967 | Broske . | |
| 3,349,167 | 10/1967 | Mixon, Jr. et al. . | |
| 3,462,543 | 8/1969 | Wahl et al. | 174/94 R |
| 3,504,332 | 3/1970 | Mixon, Jr. . | |
| 3,516,050 | 6/1970 | Mixon, Jr. et al. . | |
| 3,588,791 | 6/1971 | Polidori . | |
| 3,650,025 | 3/1972 | McLaughlin et al. | 29/882 |
| 3,920,310 | 11/1975 | Walsh et al. | 439/783 |
| 4,005,524 | 2/1977 | Schultz | 29/882 |
| 4,059,333 | 11/1977 | Mixon, Jr. | 339/247 |
| 4,447,109 | 5/1984 | Hobart, Jr. | 439/851 |
| 4,453,395 | 6/1984 | Takeda et al. | 72/348 X |
| 4,533,205 | 8/1985 | Frank | 339/247 |
| 4,600,264 | 7/1986 | Counsel | 339/247 |
| 4,634,205 | 1/1987 | Gemra | 339/97 R |
| 4,650,273 | 3/1987 | Roosdrop | 339/247 |
| 4,723,920 | 2/1988 | Werner | 439/782 |
| 4,723,921 | 2/1988 | Pooley | 439/783 |
| 4,730,087 | 3/1988 | Werner | 174/94 S |
| 4,734,062 | 3/1988 | Goto | 439/783 |
| 4,813,894 | 3/1989 | Mixon, jr. | 439/783 |
| 4,820,207 | 4/1989 | Zic | 439/825 |
| 4,863,403 | 9/1989 | Shannon | 439/783 |
| 4,872,856 | 10/1989 | Pooley et al. | 439/783 |
| 4,915,653 | 4/1990 | Mair | 439/781 |
| 5,006,081 | 4/1991 | Counsel et al. | 439/783 |
| 5,044,993 | 9/1991 | El-Haj et al. | 29/882 |
| 5,044,996 | 9/1991 | Goto | 439/783 |
| 5,145,420 | 9/1992 | Counsel et al. | 439/783 |
| 5,244,422 | 9/1993 | Laricchia | 439/783 |
| 5,527,994 | 6/1996 | Kasper | 29/868 X |

OTHER PUBLICATIONS

"Ampact Grounding System", AMP Corporation, Mar. 1988, pp. 1–16.

*Primary Examiner*—Peter Vo
*Attorney, Agent, or Firm*—Perman & Green, LLP

[57] ABSTRACT

An electrical wedge connector having a C-shaped sleeve and a one-piece wedge. The wedge has a generally tubular wedge shape with a hollow interior, a constant wall thickness, and two conductor contacting surfaces for sandwiching conductors against an interior side of the sleeve. The wedge can be formed by deep drawing or tube forming.

10 Claims, 5 Drawing Sheets

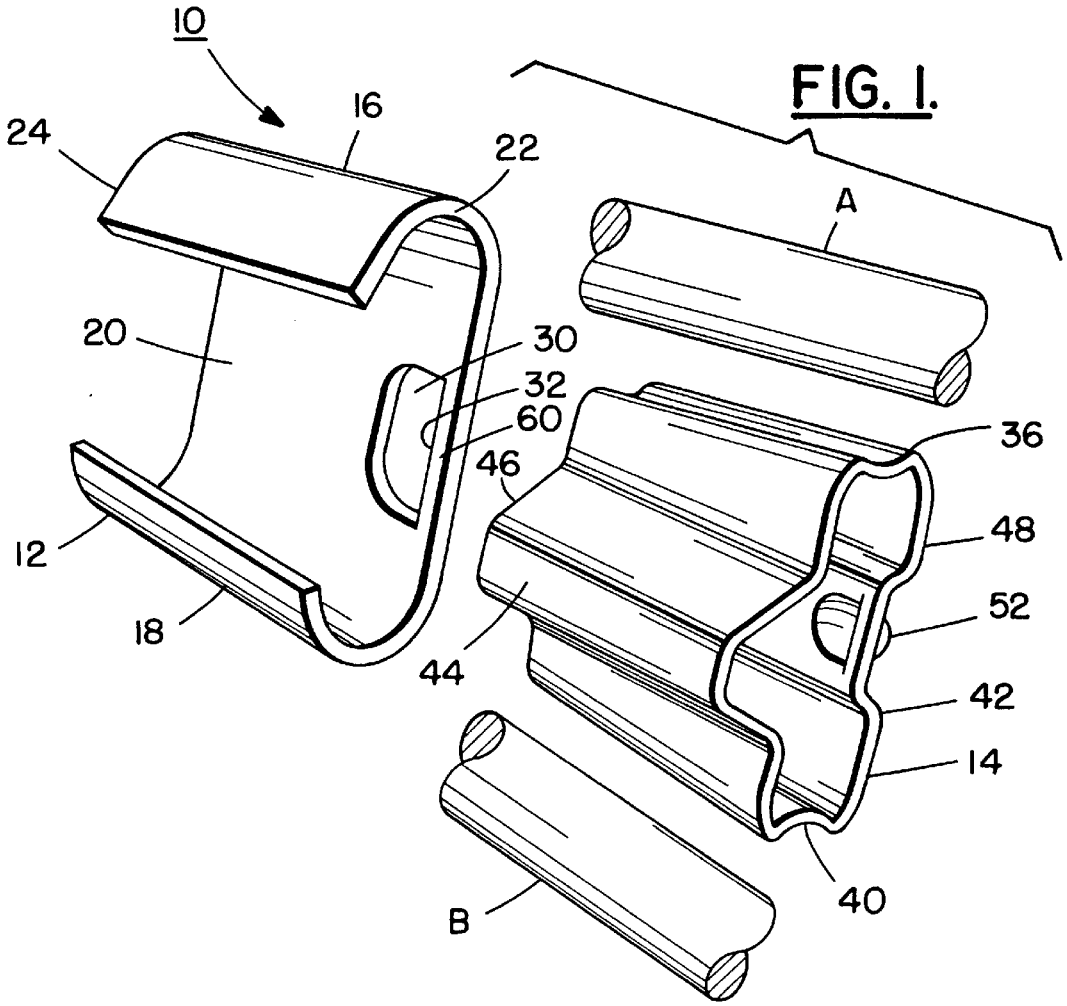
FIG. 1.
FIG. 2B.
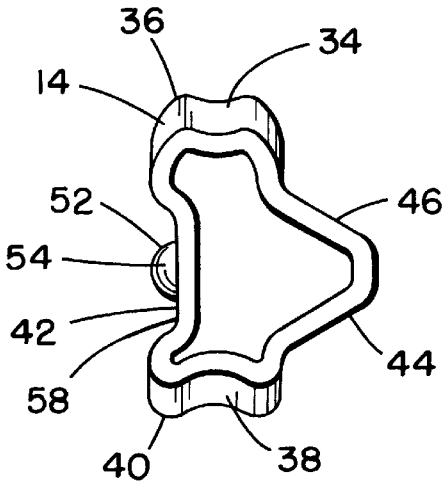
FIG. 2A.
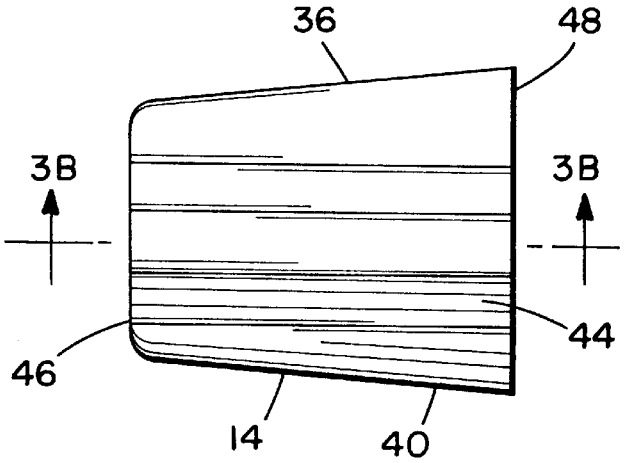

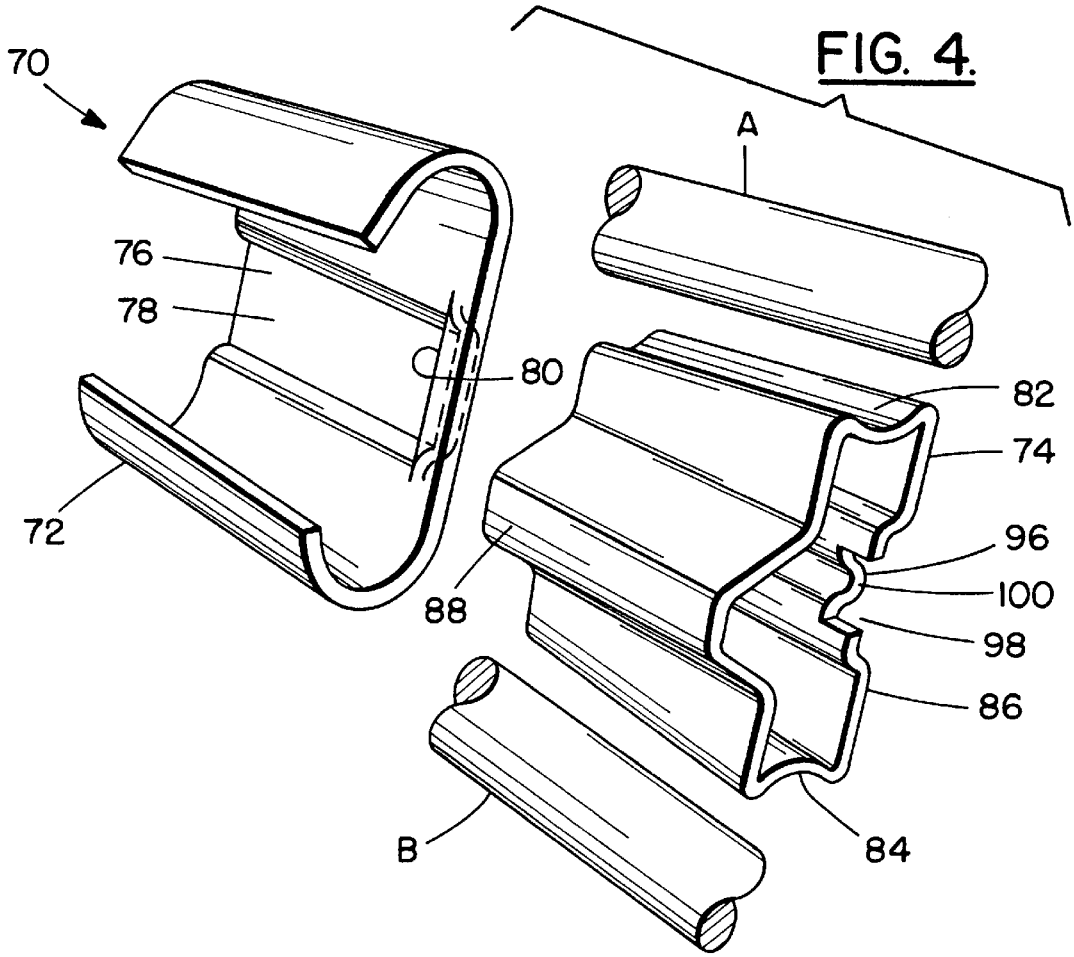
FIG. 4.
FIG. 5B.
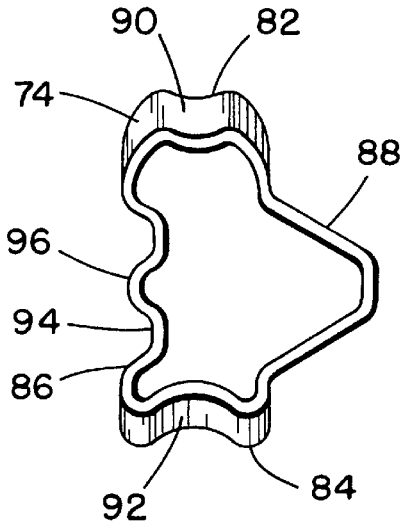
FIG. 5A.
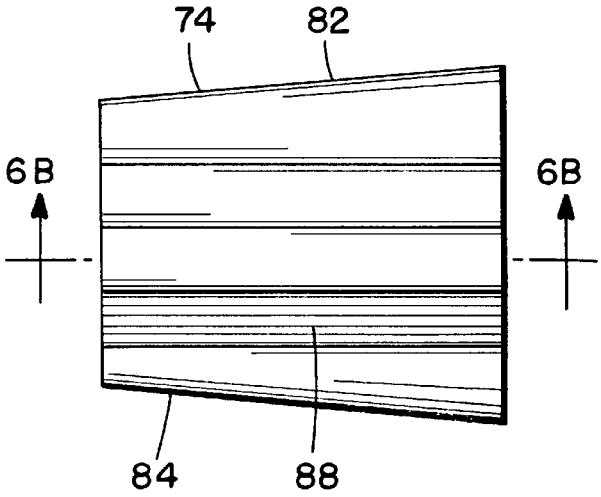

TUBULAR WEDGE FOR AN ELECTRICAL WEDGE CONNECTOR

This is a divisional of application Ser. No. 08/353,187 filed Dec. 9, 1994, now U.S. Pat. No. 5,830,019.

BACKGROUND OF THE INVENTION

1. Field of the Invention

The present invention relates to electrical connectors and, more particularly, to a wedge connector.

2. Prior Art

U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge. Other U.S. Patents that relate to wedge connectors include the following:

| | |
|---|---|
| 2,106,724 | 2,814,025 |
| 2,828,147 | 3,065,449 |
| 3,275,974 | 3,329,928 |
| 3,349,167 | 3,462,543 |
| 3,504,332 | 3,516,050 |
| 3,588,791 | 3,920,310 |
| 4,059,333 | 4,533,205 |
| 4,600,264 | 4,634,205 |
| 4,723,920 | 4,723,921 |
| 4,730,087 | 4,734,062 |
| 4,813,894 | 4,863,403 |
| 4,872,856 | 4,915,653 |
| 5,044,996 | 5,145,420 |
| 5,244,422 | |

SUMMARY OF THE INVENTION

In accordance with one embodiment of the present invention an electrical wedge connector is provided comprising a connector sleeve and a one-piece wedge. The wedge is suitably sized and shaped to be inserted into the sleeve. The wedge has a generally tubular wedge shape with two conductor contacting surfaces for sandwiching conductors against an interior side of the sleeve.

In accordance with another embodiment of the present invention an electrical wedge connector is provided comprising a sleeve and a one-piece wedge. The sleeve has a general cross-sectional C-shape. The wedge is suitably sized and shaped to be inserted into the sleeve. The wedge has a tubular wedge configuration with a hollow interior, a substantially constant wall thickness, and exterior conductor contacting surfaces.

In accordance with one method of the present invention a method for manufacturing a wedge for an electrical wedge connector is provided comprising steps of deep drawing metal to form a cup shaped member; and cutting an opening in a bottom of the member to form a general tubular shape.

In accordance with another method of the present invention a method of manufacturing a wedge for an electrical wedge connector is provided comprising steps of providing a member having a tube shape; and deforming the member to form a tube shaped wedge with a hollow interior, an open front and rear, and two inwardly curved conductor contact surfaces.

BRIEF DESCRIPTION OF THE DRAWINGS

The foregoing aspects and other features of the invention are explained in the following description, taken in connection with the accompanying drawings, wherein:

FIG. 1 is an exploded perspective view of an electrical wedge connector incorporating features of the present invention;

FIG. 2A is an elevational side view of the wedge shown in FIG. 1;

FIG. 2B is an elevational front view of the wedge shown in FIG. 2A;

FIG. 4 is an exploded perspective view of an alternate embodiment of an electrical wedge connector incorporating features of the present invention;

FIG. 5A is an elevational side view of the wedge shown in FIG. 4;

FIG. 5B is an elevational front view of the wedge shown in FIG. 5A;

DETAILED DESCRIPTION OF THE PREFERRED EMBODIMENTS

Figure 2C:
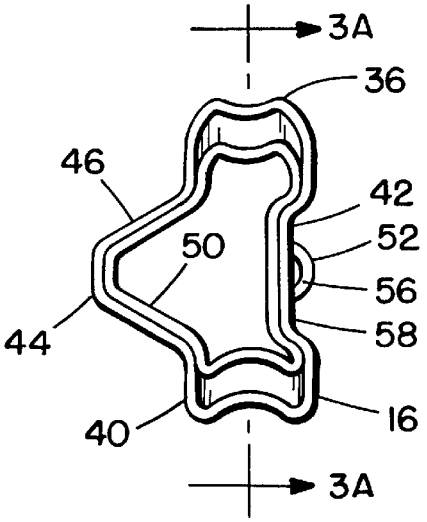
FIG. 2C is an elevational rear view of the wedge shown in FIG. 2A.
Figure 3A:
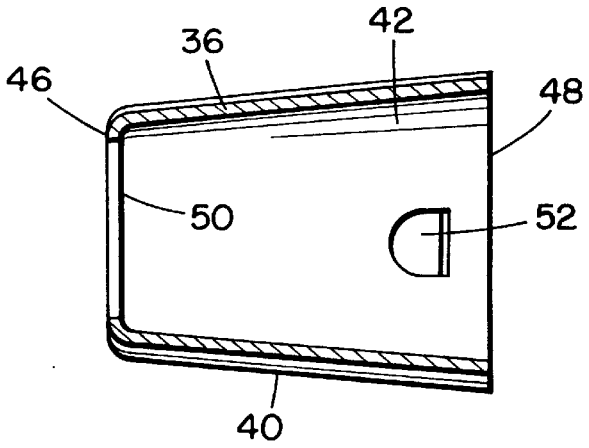
FIG. 3A is a cross-sectional view of the wedge shown in FIG. 2C taken along line 3A—3A.
Figure 3B:
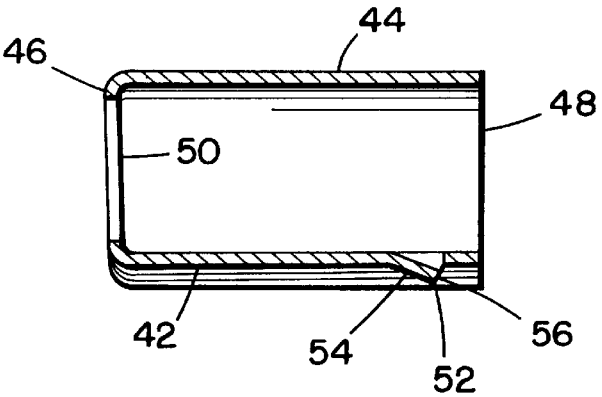
FIG. 3B is a cross-sectional view of the wedge shown in FIG. 2A taken along line 3B—3B.

Referring to FIG. 1, there is shown an exploded perspective view of a wedge connector 10 for connecting two electrical conductors A, B together. Although the present invention will be described with reference to the embodiments shown in the drawings, it should be understood that the present invention can be embodied in many alternate embodiments. In addition, any suitable size, shape or type of elements or materials could be used.

The connector 10 generally comprises a connector sleeve or shell 12 and a wedge 14. The sleeve 12 is preferably made of metal, but it could also be made of other materials. The sleeve 12 has two opposing channel sections 16, 18 interconnected by a middle section 20 to form a general cross-sectional "C" shape. The "C" shape tapers from the rear end 22 to the front end 24. The middle section 20 includes a notch or slot 30. The slot 30 is located proximate the rear end of the sleeve and forms a stop ledge 32. The slot 30 extends entirely through the middle section 20 from the interior surface to the exterior surface. However, in an alternate embodiment, the slot 30 need not extend entirely through the middle section 20.

Referring also to FIGS. 2A–2C and 3A–3B, the wedge 14 is a one-piece member preferably made of drawn metal. The wedge 14 is suitably sized and shaped to be inserted into the sleeve 12 and wedge the conductors A, B against the sleeve 12 at the channel sections 16, 18. The wedge 14 has a general tubular wedge shape or general cone shape with a substantially hollow interior, a conductor contacting surface 34 on a first top side 36, a conductor contacting surface 38 on a second bottom side 40, a third side 42 and a fourth side 44. Both the front end 46 and the rear end 48 are substantially open. The front end 46, in the embodiment shown, has a slight inwardly directed lip 50. The two conductor contacting surfaces 34, 38 have an inward curve to form seats for the conductors A, B. The surfaces 34, 38 are for sandwiching the conductors A, B against the interior side of the sleeve 12.

The third side 42 has a lateral projection 52 for latching with the sleeve 12. The projection 52 is located proximate the rear end 48. The projection 52 has a curved dome shaped front 54 and a step shaped rear 56. The projection 52 is located in a longitudinal recess 58 on the third side 42. The projection 52 and slot 30 are suitably sized, shaped and positioned such that the projection extends into the slot 30 when the wedge 14 is fully inserted into the sleeve 12. More specifically, the curved front 54 of the projection 52 is adapted to deflect the projection 52 over the rear section 60 of the sleeve 12. The rear 56 is adapted to engage stop ledge 32 to prevent accidental withdrawal of the wedge 14 from the sleeve 12. The fourth side 44 has a protruding shape that extends laterally outward between the top and bottom sides 36, 40. The fourth side 44, in the embodiment shown, has a general pyramid profile as seen best in FIGS. 2B and 2C. When the wedge 14 is inserted into the sleeve 12, a portion of the pyramid profile can extend out of the sleeve 12 at the open lateral area of the general cross-sectional C-shape.

Figure 7:
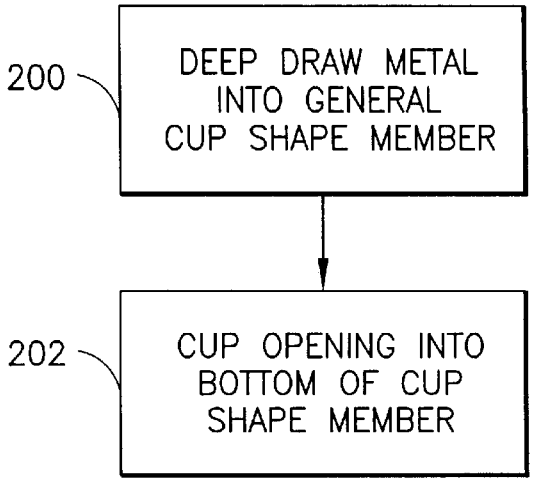
FIG. 7 is a block diagram of one method used to form the wedge.
Figure 7A:
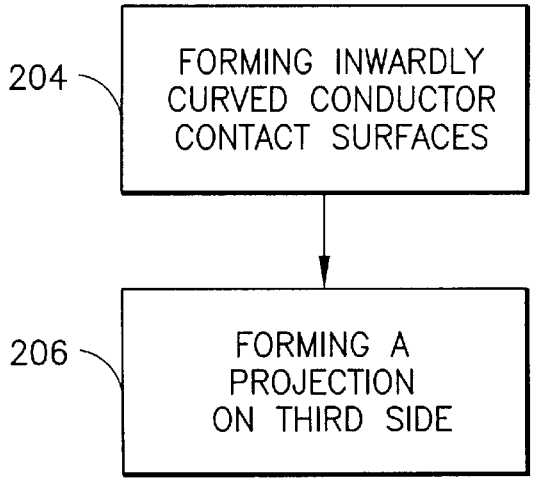
FIG. 7A is a block diagram of some steps used in the method shown in FIG. 7.
Figure 8:
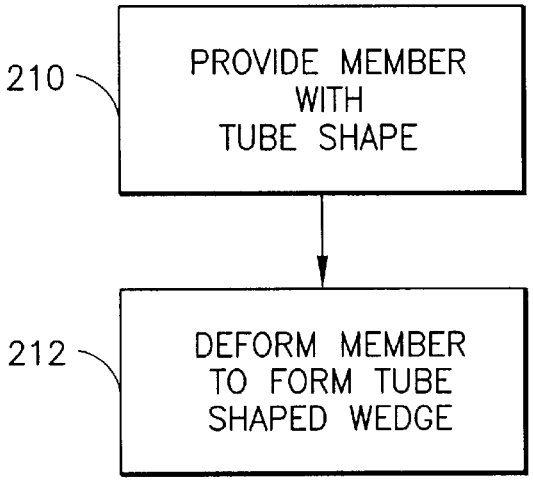
FIG. 8 is a block diagram of another method used to form the wedge.

As seen in FIG. 7, the wedge 14 is preferably made by deep drawing metal into a general cup shape member as shown by block 200. An opening in the bottom of the cup shape member would then be cut out as shown by block 202 to form the front end 46 and general tubular shape. As seen in FIG. 7A, the step 200 of deep drawing preferably comprises forming the inwardly curved conductor contact surfaces as shown by block 204. The method includes forming the projection on a third side as shown by block 206. As shown by FIG. 8 in an alternate method, a member having a general tube shape could be provided as shown by block 210. The member would then be deformed to form a tube shaped wedge with a hollow interior, open front and rear, and the inwardly curved conductor contact surfaces as shown by block 212. These methods allow all side walls of the wedge to be integrally continuous with adjacent side walls. The thickness of the side walls is preferably varied, but can be kept at a substantially constant thickness throughout the wedge to enhance predictability.

Referring now to FIG. 4, an alternate embodiment of the present invention is shown. The connector 70 has a sleeved 72 and a wedge 74. The sleeve 72 has a general cross-sectional C-shape with a longitudinal groove 76 along its middle section 78 and a stop ledge 80 at a rear end of the groove 76. Referring also to FIGS. 5A–5C and 6A–6B, the wedge 74 is a one-piece tubular member. The wedge 74 has been made by deforming a tube shaped member into the shape shown. However, any suitable type of tubular wedge forming process could be used. The four sides 82, 84, 86, 88 are integral to adjacent sides. The top and bottom sides 82, 84 have conductor contacting surfaces 90, 92 for sandwiching the conductors A, B against the sleeve 72. The fourth side 88 has a general pyramid profile. The third side 86 has a recessed area 94 with a projection 96. The projection 96 extends substantially the entire length of the wedge. However, located at a rear end of the third side 86 is cut out area 98 that forms a latching surface 100 at the rear end of the projection 96. The latching surface 100 is adapted to engage the stop ledge 80, after the wedge 74 has been inserted into the sleeve 72, to prevent the wedge 74 from inadvertently exiting the sleeve 72. The groove 76 in the sleeve 72 is generally provided to accommodate the projection 96.

Figure 5C:
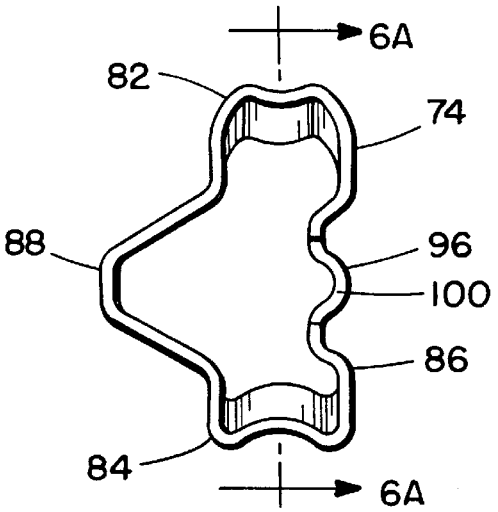
FIG. 5C is an elevational rear view of the wedge shown in FIG. 5A.
Figure 6A:
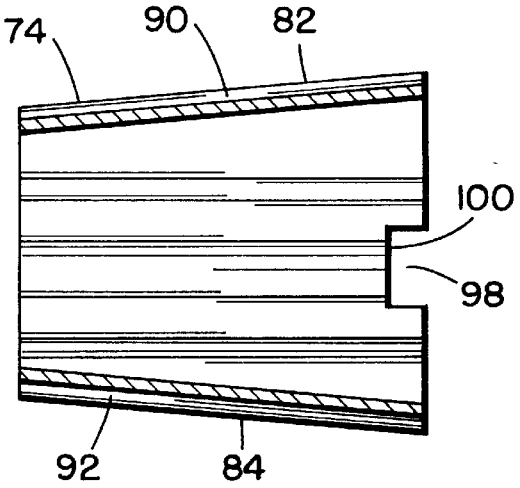
FIG. 6A is a cross-sectional view of the wedge shown in FIG. 5C taken along line 6A—6A.
Figure 6B:
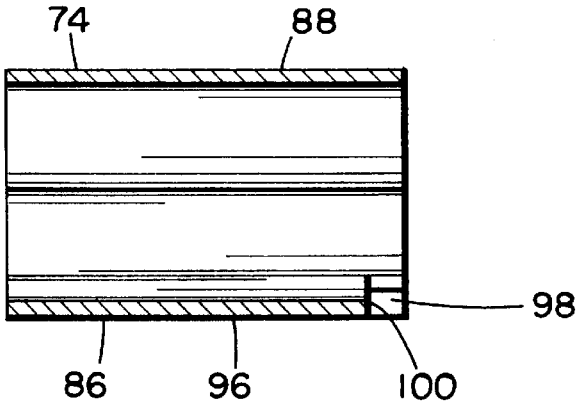
FIG. 6B is a cross-sectional view of the wedge shown in FIG. 5A taken along line 6B—6B

As can be seen in FIGS. 5B and 5C, prior to insertion into the sleeve, the leading edge of the projection 96 is generally flush with the leading edge of the third side 86 at the top and bottom of the wedge. Thus, the projection 96, at the front of the wedge 74 does not encounter obstruction to insertion into the sleeve 72 by the rear end of the sleeve. However, because the sleeve 72 and the wedge 74 are suitably sized and shaped to wedgingly sandwich the conductors A, B therebetween, and the wall thickness and shape of the wedge allows the wedge to be deformed and also function as a spring wedge, the third and fourth walls move laterally outward when the wedge 74 is inserted into the sleeve 72 with conductors therebetween.

The groove 76 in the sleeve 72 allows the projection 96 to move laterally outward. This allows the latching surface 100 to be moved in front of the stop ledge 80. In an alternate embodiment of the present invention, a sheet metal member could be deformed into the tube shaped wedged. It should also be understood that the terms "top" and "bottom" have been used for descriptive purposes only. The sleeve and wedge could be orientated in any suitable position, so long as they can be properly connected to each other. Other shapes of wedges and sleeves could also be used while still practicing the features of the present invention. Other types of means for locking the wedge with the sleeve could also be provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A method of manufacturing a wedge for an electrical wedge connector comprising steps of:

deep drawing metal to form a cup shaped member;

cutting an opening in a bottom of the cup shaped member to form the cup shaped member into a general tubular shape; and deforming the general tubular shape into a general tubular wedge shape.

2. A method as in claim 1 wherein walls of the general tubular wedge shaped member are provided with a thickness allowing the wedge shaped member to resiliently deform and function as a spring wedge.

3. A method as in claim 1 wherein the step of deep drawing comprises forming first and second sides with inwardly curved conductor contacting surfaces.

4. A method as in claim 3 further comprising forming a projection on a third side having a dome shaped front and a latching surface rear.

5. A method as in claim 3 further comprising forming a projection on a side of the tubular wedge shaped member having a protruding shape that extends laterally outward between the first and second sides.

6. A method as in claim 5 wherein the protruding shape forms a general pyramid profile.

7. A method of manufacturing a wedge for an electrical wedge connector comprising steps of:

providing a member having a tube shape; and deforming the member to form a tube shaped wedge with a hollow interior, an open front and rear, and two inwardly curved conductor contact surfaces, wherein walls of the tube shaped wedge are provided with a thickness allowing the member to resiliently deform and function as a spring wedge.

8. A method as in claim 7 further comprising forming a projection, between the two inwardly curved conductor contact surfaces, having a protruding shape that extends laterally outward between the two conductor contact surfaces.

9. A method as in claim 8 wherein the protruding shape hass a general pyramid profile.

10. A method of manufacturing a wedge for an electrical wedge connector comprising steps of:

providing a member having a tube shape; and deforming the member to form a tube shaped wedge with a hollow interior, an open front and rear, and two inwardly curved conductor contact surfaces on exterior sides running along the entire length of the tube shaped wedge.

* * * * *